US008021722B2

(12) United States Patent
Draper

(10) Patent No.: US 8,021,722 B2
(45) Date of Patent: Sep. 20, 2011

(54) METHOD OF MAKING AN INDUSTRIAL FABRIC

(75) Inventor: Michael David Draper, Lancashire (GB)

(73) Assignee: Voith Patent GmbH, Heidenheim (DE)

( * ) Notice: Subject to any disclaimer, the term of this patent is extended or adjusted under 35 U.S.C. 154(b) by 988 days.

(21) Appl. No.: 10/550,421

(22) PCT Filed: Mar. 18, 2004

(86) PCT No.: PCT/EP2004/050324

§ 371 (c)(1), (2), (4) Date: Jan. 26, 2007

(87) PCT Pub. No.: WO2004/083500

PCT Pub. Date: Sep. 30, 2004

(65) Prior Publication Data

US 2007/0184206 A1 Aug. 9, 2007

(30) Foreign Application Priority Data

Mar. 21, 2003 (GB) ..... 0306502.6

(51) Int. Cl.
*C08F 2/48* (2006.01)

(52) U.S. Cl. ..... 427/508; 427/487; 427/517; 427/519; 427/521

(58) Field of Classification Search ..... 427/487, 427/508, 517, 519, 521
See application file for complete search history.

(56) References Cited

U.S. PATENT DOCUMENTS

| | | | | | |
|---|---|---|---|---|---|
| 2,300,155 | A | * | 10/1942 | Heintz | 428/201 |
| 4,358,490 | A | * | 11/1982 | Nagai | 428/34 |
| 5,592,325 | A | * | 1/1997 | Dodge et al. | 359/326 |
| 5,824,373 | A | * | 10/1998 | Biller et al. | 427/474 |
| 5,865,733 | A | * | 2/1999 | Malinouskas et al. | 600/300 |
| 6,995,194 | B2 | * | 2/2006 | Moens et al. | 522/111 |

* cited by examiner

*Primary Examiner* — Elena T Lightfoot
(74) *Attorney, Agent, or Firm* — Taylor IP, P.C.

(57) ABSTRACT

The present invention relates to a method of making an industrial fabric including the steps of applying a radiation-curable powder onto the surface of a fabric, melting the radiation-curable powder such that the powder forms a layer on the fabric surface and directing radiation at this surface layer so as to cure the constituent material of the surface layer.

14 Claims, No Drawings

METHOD OF MAKING AN INDUSTRIAL FABRIC

BACKGROUND OF THE INVENTION

1. Field of the Invention

The present invention relates to industrial fabrics, and particularly, but not exclusively, to papermachine fabrics. A preferred use of the fabrics of the present invention is as press felts for use In the press section of a papermaking machine.

2. Description of the Related Art

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Paper machine clothing is essentially employed to carry the paper web through these various stages of the papermaking machine. In the forming section the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. Press fabrics generally comprise a batt of fibres needled to a base fabric. In the final stage, the paper web is transferred either to a Yankee dryer, in the case of tissue paper manufacture, or to a set of dryer cylinders upon which, aided by the clamping action of the dryer fabric, the majority of the remaining water is evaporated.

Most papermachine clothing is nowadays made from textile materials usually comprising polymeric yarns and or fibres. In an attempt to extend the lifespan and improve the performance of these fabrics GB 1,512,558 teaches the application of a resin coating to the fabric yarns, the resin coating being applied as a solution in organic solvent. However, the use of such solvents leads to unacceptable environmental problems. U.S. Pat. No. 4,439,481 relates to a press fabric to which one of a number of suitable synthetic polymeric resins is applied. Suitable polymeric resins are said to include polyolefins, such as polyethylene, ethylene copolymers, polypropylene, polyamides, fluorinated ethylene propylene, polyvinylchloride, polyvinylidene fluoride and acrylic polymers, B-stage thermosetting resins and liner epoxy resins. In the example, a fabric is immersed in a dip tank containing epoxy resin. The coating increases the stiffness of the press fabric and makes it more resistant to compression. This enhances the performance of the fabric in removing water from the paper web. However, the use of strong organic solvents is usually required in order to dissolve the epoxy resin prior to coating the fabric. This solvent must later be removed leading once again to environmental problems.

In U.S. Pat. No. 4,847,116 a press fabric is made by applying, to a base fabric, a homogeneous foam coating composed of resin particles, binder and solvent. The solvent is then evaporated by heat to fuse the resin particles to each other and to the base fabric. This method consumes considerable energy in providing the heat to evaporate the solvent.

In U.S. Pat. No. 4,571,359 a layer of particles of a synthetic polymeric resin is located on a base fabric. The particles are then sintered by heating so that they bond together and with the base fabric. Again this process involves a costly treating step. A similar method is described in U.S. Pat. No. 5,508,095 except in that a fabric is embedded within the sintered structure.

In U.S. Pat. No. 5,508,095 a layer of plastics powder material comprising soluble corpuscles is applied to a base fabric. By heat and pressure treatment a plastics layer is produced. The soluble corpuscles are leached out from this layer to provide through flow passages. Again this process involves a costly heating step.

In GB 2,200,867 additives are included in the needled batt layer of a papermakers felt so as to increase the contact area with the web. These additives are prone to wear and drastically reduce the belt porosity.

SUMMARY OF THE INVENTION

The present invention seeks to provide a more efficient and less time consuming method of making industrial fabrics, such as papermachine clothing, having good abrasion resistance and smooth surface topography. The process has particular, but not exclusive, application in making papermachine clothing such as forming, press or dryer fabrics as well as for through air dryer (TAD) fabrics and other fabrics for use in the nonwovens industry. The invention has particular application in the manufacture of press felts since the improved surface topography increases the web contact area of such felts, especially in the nip and also provides improved surface fibre anchorage.

DETAILED DESCRIPTION OF THE INVENTION

According to a first aspect of the present invention there is provided a method of making an industrial fabric comprising the steps of applying a radiation-curable powder onto the surface of a fabric, melting the powder such that the powder forms a layer on the fabric surface and directing radiation at this surface layer so as to cure the constituent material of this surface layer.

For the avoidance of doubt the term fabric used herein relates to the fabric as a whole and not, for example, in the case of press felts, just to the base fabric.

The invention enables polymeric particles to be melted and a specific surface topography to be formed before the polymeric powder is cured.

The method of the invention is advantageous in that it avoids the use of solvents, for example water or toxic volatile organic compounds (VOCs) such as dichloromethane, formaldehyde or toluene. Consequently, the process obviates the need for a costly energy consuming drying stage. Curing in the process of the invention is emission free and non toxic. Furthermore, the process may be completed quickly as melting and curing together generally taking take less than 3 minutes. Also thick coating layers can be applied in a single application. A further advantage is that very little radiation curable material is wasted during the process.

The method of the invention may be used to produce either porous coatings or non-porous coatings. A non-porous coating can be achieved by applying a thick coating layer, or several subsequent coating layers on top of each other.

A porous coating can be achieved by adding a thin coating layer and/or by first wetting the fabric substrate with water or another liquid before applying the layer of UV-curable powder. Degassing by drying off the liquid will then result in pin holes forming in the film or powder coating layer during the heating and melting stage that will form small pores in the surface. In other words, the liquid is dried off in the heating and melting stage to form small pin holes in the powder coating layer.

Ultra-violet curable powder technology is based on solid polymer resins containing unsaturated groups. The crosslinking reaction is initiated by decomposition of an initiator, for example, 1-Hydroxy cyclohexyl phenyl ketone (HCPK), a-hydroxy ketone (AHK) or bisacyl phoshine oxide (BAPO), contained in the powder, upon exposure to UV light, which in turn starts a free-radical polymerisation of the unsaturated groups of the resin. Typical unsaturated groups include acrylate, methacrylate, vinyl ether, maleimide and epoxide or maleic and fumaric double bonds. Suitable UV curable powder coating compositions are known in the art, for example from U.S. Pat. No. 5,558,911 and US 2002/0099127. Other examples include Uvecoat 1000 & 2100 unsaturated polyesters, Uvecoat 2000 amorphous polyester, Uvecoat 3000 an amorphous unsaturated polyester (all Ucb chemicals), XZ92478.00 an epoxy resin (Dow Chemical Company), whilst Syncryl 206 an acrylated polyester & Syncryl 306 an acrylated polyurethane (both Galstaff Resins) are other 100% active materials.

The powder is preferably applied to the fabric by electrostatically spraying the powder onto the surface of the fabric. Powder coatings can be easily applied onto textile substrates by Corona electrostatic spray guns or by tribo-charging guns. The fabric can also be preheated if necessary to aid the powder application by enabling the powder to stick to the fabric.

The powder is preferably melted by using heat. This is ideally provided by hot air at a temperature preferably in the range from 100° C. to 150° C. and/or by incident infrared radiation of wavelength in the range from $10^{-8}$ to $10^{-3}$ m (10,000 to 10 $cm^{-1}$).

Unlike a thermosetting powder coating, the molten UV curable powder does not start crosslinking under the influence of heat. This facilitates optimum flow out and smooth coating finishes which may be achieved at relatively low temperatures of 90° C. to 140° C. As no thermal curing reaction takes place, flow of the finishes can be adjusted without affecting the reactivity of the system.

The powder is preferably cured by way of ultra-violet light of wavelength in the range from $10^{-8}$ to $10^{-6}$ m (10 to 1000 nm). Fast curing is achieved by a free radical polymerisation process by exposing the coating to UV light at room temperature (18-25° C.). The curing reaction with UV light is very fast (a few seconds) and proceeds at low temperatures.

Since two distinct mechanisms are involved; i.e. melting (thermal) and curing (via UV irradiation), parameters can be easily adjusted in order to optimise flow without affecting curing conditions. Thus the use of UV light for the crosslinking reaction provides a definite advantage over conventional processing of thermoset powder. Unlike conventional powder coating, separation of the powder melting and flow out stages from the subsequent UV-cure step gives UV curable powders a wide processing window.

Coating thickness can be controlled e.g. between 60-150 micron. Again, due to the fact that the melting and curing processes are two separate processes, high quality finishes with outstanding flow are achievable. This technology will also enable damaged fabrics to be repaired on papermill sites using hand-held infrared heaters and UV guns.

According to a second aspect of the present invention there is provided a method of repairing a damaged industrial fabric comprising the steps of applying a radiation-curable powder to the surface of the damaged area of the fabric, melting the powder such that the powder forms a layer within the damaged area which is continuous with the surface of the undamaged area of the fabric, and directing radiation at the melted powder so as to cure the melted powder.

In order that the present invention may be more readily understood a specific embodiment thereof will now be described by way of example only with reference to the following example.

EXAMPLE 75 gsm of Uvecoat 2100 (Ucb Chemicals) unsaturated polyester powder is electrostatically sprayed onto the surface of a conventional press fabric. The powder is then melted using infrared radiation and smoothed, whilst molten, using a non-stick roll. The molten surface is then cured by irradiating with UV light.

It is to be understood that the above described embodiment is by way of illustration only. Many modifications and variations are possible.

The invention claimed is:

1. A method of making an industrial fabric comprising the following steps:

wetting a surface of the industrial fabric with a liquid;

applying a radiation-curable powder onto the surface of the fabric after said melting step;

melting the powder such that the powder forms a coating layer on the fabric surface;

drying off said liquid in said melting step to form pin holes in said coating layer thereby forming a porous coating layer; and directing radiation at said coating layer so as to cure the constituent material of said coating layer.

2. The method according to claim 1, wherein the powder comprises polymeric particles.

3. The method according to claim 1, wherein the powder comprises solid polymer resin containing unsaturated groups.

4. The method according to claim 3, wherein the unsaturated groups contain at least one of acrylate, methacrylate, vinyl ether, maleimide and at least one of maleic and fumeric double bonds.

5. The method according to claim 1, wherein the powder comprises at least one initiator.

6. The method according to claim 1, wherein the powder is applied to the fabric by electrostatically spraying.

7. The method according to claim 1, wherein the powder is melted by using heat.

8. The method according to claim 1, wherein the powder is cured by using UV radiation.

9. The method according to claim 1, wherein the thickness of the layer is between 60 microns and 150 microns.

10. The method according to claim 5, wherein the at least one initiator is one of 1-Hydroxy cyclohexyl phenyl ketone (HCPK), hydroxy ketone (AHK) and bisacyl phoshine oxide (BAPO).

11. The method according to claim 7, wherein the powder is heated in the range from 100° C. to 150° C.

12. The method according to claim 7, wherein the powder is heated in the range from 100° C. to 150° C., by using IR radiation in the range from 1 microns to 1 mm.

13. The method according to claim 8, wherein the powder is cured by using UV radiation.

14. The method according to claim 8, wherein the powder is cured by using UV radiation in the range from 100 nm to 450 nm.

* * * * *